US010916921B2

(12) United States Patent
Schimmel et al.

(10) Patent No.: US 10,916,921 B2
(45) Date of Patent: Feb. 9, 2021

(54) SPARK PLUG WITH IMPROVED TIGHTNESS

(71) Applicant: Robert Bosch GmbH, Stuttgart (DE)

(72) Inventors: Chris Schimmel, Waiblingen (DE); Ugur Yilmaz, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/493,030

(22) PCT Filed: Mar. 14, 2018

(86) PCT No.: PCT/EP2018/056350

§ 371 (c)(1),
(2) Date: Sep. 11, 2019

(87) PCT Pub. No.: WO2018/184801

PCT Pub. Date: Oct. 11, 2018

(65) Prior Publication Data

US 2020/0014176 A1 Jan. 9, 2020

(30) Foreign Application Priority Data

Apr. 5, 2017 (DE) ..... 10 2017 205 828

(51) Int. Cl.
*H01T 13/36* (2006.01)

(52) U.S. Cl.
CPC ..... *H01T 13/36* (2013.01)

(58) Field of Classification Search
CPC ..... H01T 13/36
See application file for complete search history.

(56) References Cited

U.S. PATENT DOCUMENTS

| | | | | |
|---|---|---|---|---|
| 5,831,377 | A | 11/1998 | Matsubara et al. | |
| 2003/0117052 | A1 | 6/2003 | Yamaguchi et al. | |
| 2005/0017622 | A1* | 1/2005 | Tamura | H01T 13/36 313/143 |
| 2011/0000453 | A1* | 1/2011 | Kuribayashi | H01T 13/38 123/169 R |
| 2012/0267995 | A1* | 10/2012 | Shimamura | H01T 13/36 313/143 |
| 2013/0015756 | A1* | 1/2013 | Yamada | H01T 13/36 313/143 |
| 2017/0033538 | A1 | 2/2017 | Kobayashi et al. | |

FOREIGN PATENT DOCUMENTS

| | | | |
|---|---|---|---|
| CN | 102598442 | A | 7/2012 |
| CN | 106170899 | A | 11/2016 |
| DE | 102013206071 | A1 | 10/2013 |
| DE | 102014223752 | A1 | 5/2016 |

OTHER PUBLICATIONS

International Search Report dated Jun. 13, 2018 of the corresponding International Application PCT/EP2018/056350 filed Mar. 14, 2018.

* cited by examiner

*Primary Examiner* — Kevin Quarterman
(74) *Attorney, Agent, or Firm* — Norton Rose Fulbright US LLP; Gerard Messina

(57) ABSTRACT

A spark plug includes an insulator, a housing, and a deformable sealing washer disposed between the insulator and the housing, the insulator having an annular full-perimeter shoulder against which the sealing washer rests, and the shoulder having a radius in a range of between 0.20 mm and 0.60 mm.

14 Claims, 2 Drawing Sheets

SPARK PLUG WITH IMPROVED TIGHTNESS

CROSS-REFERENCE TO RELATED APPLICATIONS

The present application is the national stage of International Pat. App. No. PCT/EP2018/056350 filed Mar. 14, 2018, and claims priority under 35 U.S.C. § 119 to DE 10 2017 205 828.5, filed in the Federal Republic of Germany on Apr. 5, 2017, the content of each of which are incorporated herein by reference in their entireties.

FIELD OF THE INVENTION

The present invention relates to a spark plug with improved tightness between an insulator and a housing of the spark plug.

BACKGROUND

Spark plugs in various forms are known from the related art. Because of the increasing demands of manufacturers of internal combustion engines with regard to a downsizing of engines, smaller spark plugs are also needed. Thus, the trend is away from spark plugs with an M14 external thread to spark plugs with an M10 or M8 external thread. However, this entails increased requirements of the spark plug with respect to sturdiness, gas tightness, and thermal stability. DE 10 2014 223 752.1 describes a spark plug which features an improved connection between the insulator and the housing. In that case, at its periphery, the insulator has a circumferential depression in which the housing engages.

SUMMARY

Embodiments of the present invention are directed to improved design approaches in terms of gas tightness and ruggedness of spark plugs.

In contrast to conventional spark plugs, a spark plug according to an example embodiment of the present invention has an advantage that dimensions of the spark plug are able to be reduced, and sealing of the spark plug between an insulator and a housing of the spark plug can be improved. This is achieved owing to the fact that the spark plug has an insulator, a housing, and a sealing washer disposed between the insulator and the housing of the spark plug. The sealing washer is deformable and the insulator has an annular full-perimeter shoulder against which the sealing washer rests. The shoulder has a radius R1 which lies in a range between 0.20 mm and 0.60 mm. The material of the sealing washer is selected in such a way that deformability of the insulator and of the housing is less than a deformability of the sealing washer. The sealing washer can thus be deformed reliably during assembly. Due to the selection of the small radius between 0.20 mm and 0.60 mm, increased Hertzian surface pressure can be achieved during the assembly operation.

Particularly high surface pressure can be achieved if the radius at the shoulder of the insulator is directed outwardly. In other words, the external radius is convex.

It is particularly preferred that the radius lies in a range from 0.30 mm to 0.50 mm, and especially preferred, amounts to 0.40 mm.

Viewed in the axial direction, the shoulder on the insulator preferably has an arc length in a range between 20 mm and 26 mm, and especially preferred, the arc length amounts to 23 mm. This measure also further increases a surface pressure between the members being joined.

By preference, a Hertzian surface pressure of at least 4500 $N/mm^2$, preferably of at least 5000 $N/mm^2$, is present between the insulator and the sealing washer. Thus, the higher pressures occurring particularly in the case of smaller internal combustion engines can be sealed off, as well.

It is particularly preferred that the housing has a tapering section at a contact area for a contact with the sealing washer. The tapering section on the housing is preferably conical. As a result, reliable support of the sealing washer on the housing is possible during assembly, permitting a high surface pressure during the joining process.

In order to be able to ensure particularly high tightness, in the assembled state, the sealing washer completely contacts the shoulder on the insulator.

As a result, the sealing washer abuts against the entire arc length of the shoulder of the insulator, thereby permitting great tightness, especially with respect to high pressures.

It is further preferred that in the assembled state, the sealing washer completely contacts the contact area on the housing.

Preferably, the housing of the spark plug has an M10 external thread or an M12 external thread.

The present invention also relates to an internal combustion engine, including the described spark plug.

In the following, a preferred exemplary embodiment of the present invention is described in detail with reference to the accompanying drawings.

DETAILED DESCRIPTION

Figure 1:
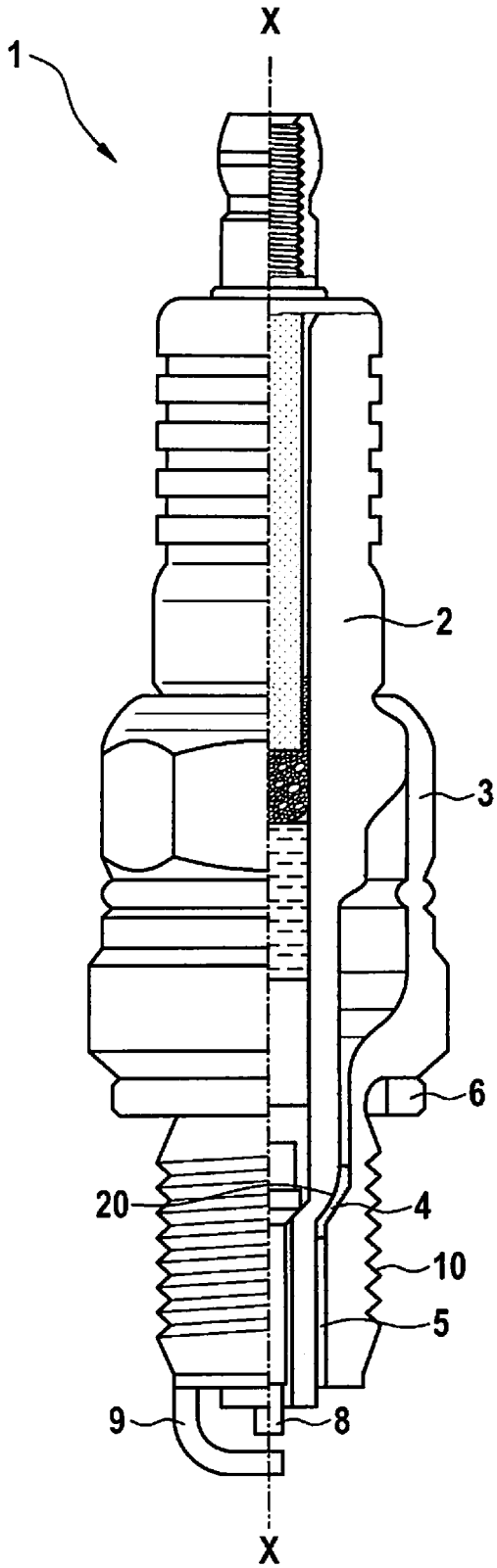
FIG. 1 shows a schematic, partial cutaway view of a spark plug according to an example embodiment of the present invention.

In the following, a spark plug 1 according to a preferred exemplary embodiment of the invention is described in detail, with reference to FIGS. 1 and 2. As shown in FIG. 1, spark plug 1 has an insulator 2 made of an electrically nonconductive material, particularly ceramic. Spark plug 1 also has a housing 3 made of a metal material. An external thread 10 is provided on housing 3.

In addition, spark plug 1 includes a center electrode 8 and a ground electrode 9. In the assembled state of spark plug 1, outer sealing ring 6 fits tightly against a cylinder head or the like.

As also evident from FIG. 1, at the end of spark plug 1, which is directed toward the combustion chamber and at which center electrode 8 and ground electrode 9 are located, a gap 5 exists between insulator 2 and housing 3. High pressures are able to get into the interior of spark plug 1 via gap 5. To prevent this, a sealing washer 4 is disposed between insulator 2 and housing 3.

Figure 2:
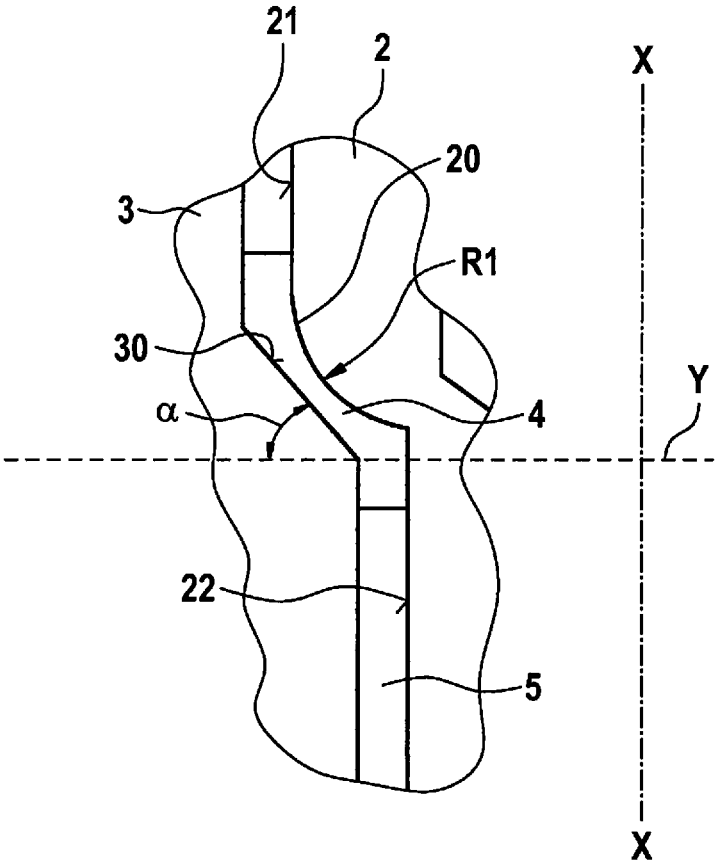
FIG. 2 shows an enlarged sectional view of the spark plug in the area of a sealing washer between a housing and an insulator of the spark plug according to an example embodiment of the present invention.

Sealing washer 4 can be seen in detail in FIG. 2. Sealing washer 4 is made of a deformable material which exhibits higher deformability than the material of the insulator and the material of the housing.

As shown in FIG. 2, insulator 2 has a shoulder 20 which is arc-shaped in section. Shoulder 20 has a radius R1. Radius R1 lies in a range from 0.20 mm to 0.60 mm, and preferably amounts to 0.40 mm.

As can be seen in FIG. 2, shoulder 20 is located between a first wall area 21 and a second wall area 22 in axial direction X-X of the spark plug. First wall area 21 is preferably cylindrical, and second wall area 22 is likewise preferably cylindrical.

A tapering section 30 is provided on housing 3 at the level of sealing washer 4. In this exemplary embodiment, tapering section 30 is conical. An angle $\alpha$ of the conical section to a perpendicular Y to axial direction X-X is preferably approximately 115°.

As also apparent from FIG. 2, in the assembled state, deformed sealing washer 4 rests completely against arc-shaped shoulder 20. In addition, deformed sealing washer 4 likewise rests completely against conical surface 30 of housing 3. Due to the selection of small radius R1, a very high Hertzian surface pressure of over 4500 N/mm$^2$ is obtained in this case.

An arc length of shoulder 20 between first and second wall areas 21, 22 lies preferably in a range from 20 mm to 26 mm, and in this exemplary embodiment, amounts to 23 mm.

Thus, tightness of the spark plug between insulator 2 and housing 3 can be improved by achieving the conditions for an increased Hertzian surface pressure between the members being joined—insulator 2, housing 3, and sealing washer 4. Combustion-chamber gases can thereby be prevented from getting into the interior of the spark plug via gap 5.

A relatively easily deformable material is used as material for sealing washer 4. Preferably, the material also has a high coefficient of thermal conduction, so that heat is able to be conducted from housing 3 in the direction of insulator 2.

As can be seen in FIG. 1, sealing washer 4 is provided in axial direction X-X of spark plug 1 at the level of external thread 10 on housing 3, particularly at the end of external thread 10 that lies in the direction toward the side of spark plug 1 facing away from the combustion chamber.

External thread 10 has reduced dimensions and is preferably an M10 external thread or an M12 external thread.

What is claimed is:

1. A spark plug, comprising:

an insulator that includes an annular full-perimeter shoulder having a radius that is in a range of 0.20 mm to 0.60 mm, wherein the shoulder is arc-shaped throughout a majority length of the shoulder;

a housing; and a deformable sealing washer resting against the shoulder of the insulator and situated between the insulator and the housing.

2. The spark plug of claim 1, wherein the radius is convex.

3. The spark plug of claim 1, wherein the range is 0.30 mm to 0.50 mm.

4. The spark plug of claim 1, wherein the radius is 0.40 mm.

5. The spark plug of claim 1, wherein the shoulder has an arc length in a range of 20 mm to 26 mm.

6. The spark plug of claim 1, wherein the shoulder has an arc length of 23 mm.

7. The spark plug of claim 1, wherein a surface pressure between the insulator and the sealing washer is at least 4500 N/mm$^2$.

8. The spark plug of claim 1, wherein a surface pressure between the insulator and the sealing washer is at least 5000 N/mm$^2$.

9. The spark plug of claim 1, wherein the housing has a section that tapers at a contact area at which the housing contacts the sealing washer.

10. The spark plug of claim 9, wherein in the assembled state, the sealing washer completely contacts the contact area of the housing.

11. The spark plug of claim 1, wherein the housing has a section that conically tapers at a contact area at which the housing contacts the sealing washer.

12. The spark plug of claim 1, wherein in an assembled state, the sealing washer completely contacts the shoulder of the insulator.

13. The spark plug of claim 12, wherein the housing has a section that tapers at a contact area at which the housing contacts the sealing washer, and, in the assembled state, the sealing washer completely contacts the contact area of the housing.

14. The spark plug of claim 1, wherein the housing has an M10 external thread or an M12 external thread.

* * * * *